United States Patent [19]

Tamura et al.

[11] Patent Number: 4,513,155

[45] Date of Patent: Apr. 23, 1985

[54] LUBRICATING OIL FOR DIESEL ENGINES

[75] Inventors: Kunimitsu Tamura, Saitama; Kunihiko Hosonuma, Tokyo, both of Japan

[73] Assignees: Nippon Mining Co., Ltd.; Mitsui Engineering & Shipbuilding Co., Ltd., both of Japan

[21] Appl. No.: 507,386

[22] Filed: Jun. 24, 1983

[30] Foreign Application Priority Data

Jun. 24, 1982 [JP] Japan ..... 57-108769

[51] Int. Cl.[3] ..... C10M 1/16

[52] U.S. Cl. ..... 585/13; 585/24

[58] Field of Search ..... 585/13, 24

[56] References Cited

U.S. PATENT DOCUMENTS

| | | | |
|---|---|---|---|
| 2,344,912 | 3/1944 | Young et al. | 585/13 |
| 2,768,129 | 10/1956 | Knox, Jr. | 585/13 |
| 3,476,687 | 11/1969 | Martinek et al. | 585/13 |
| 3,812,035 | 5/1974 | Krenowicz et al. | 585/13 |

*Primary Examiner*—Jacqueline V. Howard

*Attorney, Agent, or Firm*—Sughrue, Mion, Zinn, Macpeak, and Seas

[57] ABSTRACT

A lubricating oil for diesel engines is disclosed. This oil is based on a mixture of lubricating mineral base oil and a highly aromatic light base oil, and is highly effective in reducing the wear of the diesel engine designed to run with heavy fuels having high carbon to hydrogen ratios. The oil is also advantageous in that it does not clog the lubricant filter.

22 Claims, 5 Drawing Figures

LUBRICATING OIL FOR DIESEL ENGINES

FIELD OF THE INVENTION

The present invention relates to a lubricating oil for diesel engines and, more particularly, to a lubricating oil suitable for use in trunk piston type large bore diesel engines that run with heavy fuels having high carbon:-hydrogen (C:H) ratios.

BACKGROUND OF THE INVENTION

Due to the high cost of petroleum fuels and the necessity of producing heavier crude oils, large bore diesel engines used in ships and in stationary power engines on land have come to use heavier residual fuel and bunker fuel oil. Conventionally, these fuels were produced from bases that were not subjected to severe heat treatments such as residues obtained by subjecting petroleum oils to atmospheric or vacuum distillation. Today, with the introduction of apparatus for use in thermal cracking, processes such as visbreaking and delayed coking, an increasing amount of heavy bases thermally cracked at high temperatures are often used in combination with the fuel bases such as residues from atmospheric and vacuum distillation. Active efforts are also being made to run diesel engines with coal tar that is a by-product of carbonization of coal or tar resulting from naphtha cracking. These trends are reported on the paper No. D102 titling "The Impact of Changing Fuel Characteristics on Marine Diesel Engine Operation" at the International Congress on Combustion Engines (CIMAC) at Helsinki, 1981. However, all these attempts make fuel oil to result in increasing the C:H ratio, the residual carbon content, asphaltene content, and n-heptane insoluble content of the fuel.

Incidentally, conventional heavy fuel oils produced by mixing residual oils produced by atmospheric distillation of crude oils with residual oils generated in vacuum distillation, i.e., asphalt, have a residual carbon content of about 4 to 12 wt % and an asphaltene content of about 3 to 7 wt %, whereas heavy fuel oils produced by visbreaking process have a residual carbon content of 15 to 20 wt % and an asphaltene content of 8 to 15 wt %. Further, coal tar produced as a by-product by dry distillation of coal indeed reach a residual carbon content of 20 wt % or higher and an asphaltcnc content of 25 wt % or higher. Accordingly, fuel oils produced by mixing these oils become inevitably heavier and rich in the carbon content.

At present, medium speed trunk piston type diesel engines are widely used in main and auxiliary engines of large-scaled cargo boat and tanker and in stationary power engines on land. Conventionally, in lubricating cylinder and system of such engines, mineral oil type lubricating oils comprising as a base oil purified mineral oils having a viscosity corresponding to SAE 30–40, i.e., a dynamic viscosity at 100° C. of 8 to 16 cSt, have been used. In other words, there have been commercially available lubricating oils in which 500 neutral oil and 150 bright stock oil, each of which can be obtained by purifying a lubricating fraction obtained from paraffinic or mixed base crude oils, are used as a base oil either alone or in admixture, and which are blended with various additives.

According to the experiment conducted by the present inventors, when a marine medium speed trunk piston type diesel engine was run with the above-described carbon-rich fuels in combination with diesel engine oils using conventional mineral oils as lubricating oil bases, the engine piston ring wore more rapidly and the filter on the purification system of the lubricating oil clogged more often than when the same engine was run with ordinary petroleum residual oil. It is known that engines wear due to the corrosive attack of sulfur in fuels. To prevent this, additives that increase the base number "alkalinity" of the lubricating oil are commonly used. However, this method has proved generally ineffective in preventing the wear of an engine that runs with low-sulfur fuels such as coal tar based fuels.

With respect to the influences by the alkalinity of lubricating oil and the type of cleaning dispersing agent for preventing the wear of large bore diesel engines in which high-sulfur heavy fuels are used, there is a report titling "Modern Marine Diesel Engine Lubricants and Their Development" at the 2nd International Lubricant Symposium (April 2–5, 1979, Cairo, Egypt). Further, U.S. Pat. No. 4,169,799 discloses that for preventing engines from the wear, a combined use of hydroxy chlorinated alkylphenyl sulfide and sulfurized overbased calcium alkylphenolate is effective. However, there have not yet been found any reports that the countermeasures for preventing the wear of engines and the clogging of cleaning filter of lubricant oil are examined from the viewpoint of the base oil construction of lubricating oils.

SUMMARY OF THE INVENTION

As a result of various studies made to eliminate problems that occur in running diesel engines with carbon-rich fuels, the present inventors have found that these problems can be solved by using a diesel engine oil made of a mixture of a relatively high aromatic lubricating base oils and lubricating mineral base oils.

Therefore, the primary object of the present invention is to provide a lubricating oil that is particularly suitable for use in trunk piston type diesel engines that are designed to run with carbon-rich heavy fuels.

BRIEF DESCRIPTION OF THE DRAWINGS

FIGS. 1 (A) and 1 (B) relate to base oil compositions for the diesel engine oil of the present invention;

FIGS. 1 (C) and 1 (D) relate to conventional oil compositions;

within FIGS. 1 (A) to 1 (D) the hatched areas indicate base oils with high aromaticity and the unhatched areas represent mineral oil bases.

DETAILED DESCRIPTION OF THE INVENTION

Figure 1:
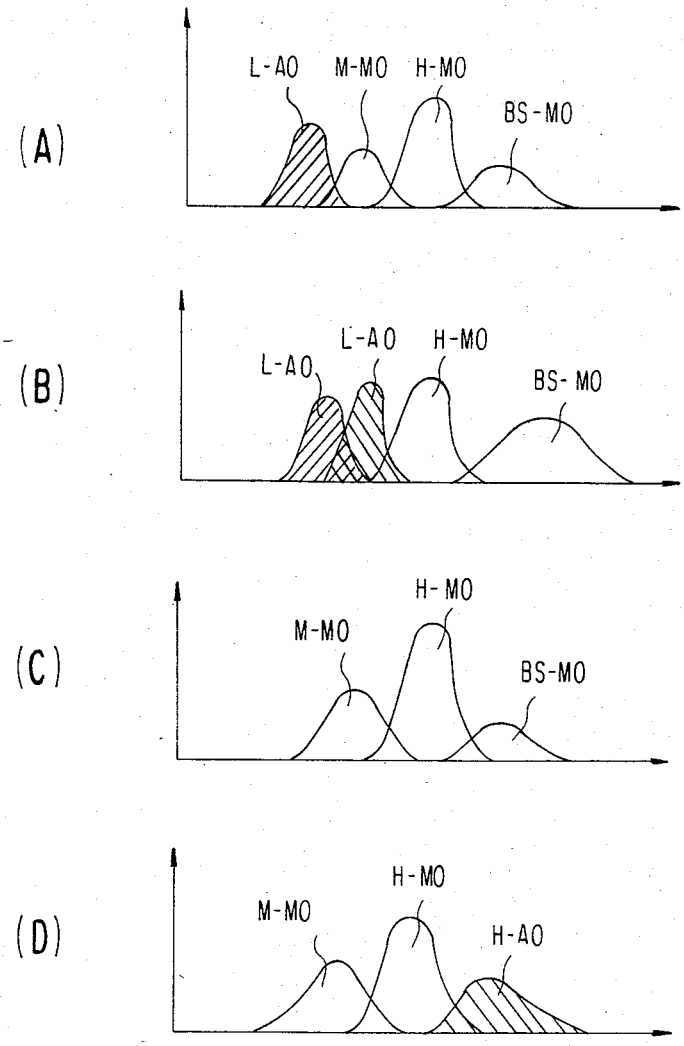
FIGS. 1 (A), 1 (B), 1 (C) and 1 (D) are graphs relating to various combinations of base oils wherein the horizontal axis indicates the distillation temperature and the vertical axis indicates the percent distilled fraction for each temperature range.

The present invention provides a lubricating oil for use in diesel engines that is prepared from a mixture of a highly aromatic light lubricating base oil with lubricating mineral base oils. More particularly, the lubricating oil according to the present invention has a base oil composition such that the front end has a higher aromaticity than the middle and back ends.

In more detail, the invention relates to a lubricating oil for use in diesel engines that is prepared from a mixture of a lubricating mineral base oil having a grade of SAE 30 to SAE 40 with a lubricating base oil comprising a highly aromatic hydrocarbon having an aromaticity of at least two times that of the above mineral oil and having a distillation temperature higher than that of the mineral oil.

In the description set forth hereunder, the aromaticity of the base oil is explained by referring to "fa" (aromaticity parameter) as a parameter expressing the aromaticity.

The parameter fa is defined by the following equation and can be measured by $^{13}$C-NMR (nuclear magnetic resonance equipment) (see *Journal of the Fuel Society of Japan,* 58, 625, pp. 350–358, 1979):

$$fa = \frac{A_1 + A_2 + A_3}{A_1 + A_2 + A_3 + A_4}$$

wherein $A_1$ to $A_4$ are measured by $^{13}$C-NMR and each has the following meaning according to Table 3 in *Journal of the Fuel Society of Japan, supra:*

$A_1$: a spectral band intensity at 150–170 ppm from TMS (trimethyl silane);

$A_2$: a spectral band intensity at 130–150 ppm;

$A_3$: a spectral band intensity at 100–130 ppm; and $A_4$: a spectral band intensity at 8–58 ppm.

Among these four band intensities, the first three are ascribable to aromatic hydrocarbons, and the last-mentioned to saturated hydrocarbons, with $A_1+A_2+A_3+A_4$, as well as $A_1+A_2+A_3$ being represented by integrated values on a $^{13}$C-NMR spectrum chart.

The term "highly aromatic light lubricating base oil" as used in the present invention means any hydrocarbon oil that has an aromaticity represented by $fa \geqq 0.22$ and also which distills off in the temperature range of about 270° to 450° C. as calculated at 1 atm.

The highly aromatic light lubricating base oil is used by mixing with a lubricating mineral oil. As the lubricating mineral oil, 500 neutral oil and 150 bright stock oil, each of which can be obtained from paraffinic or mixed base crude oils, can be used either alone or in admixture, which should have a dynamic viscosity at 100° C. of about 9 to 16 cSt. Accordingly, the lubricating mineral oil has an initial boiling point of about 350° C., but a major part of the fractions of the lubricating mineral oil have a boiling point of about 450° C. (calculated at 1 atm.) or higher. Usually, the lubricating mineral oil has an fa of about 0.10 to 0.13. On the other hand, as the highly aromatic light lubricating base oil to be mixed, those having distillation properties lower than those of the lubricating mineral oil, i.e., those which can be distilled out at a temperature of about 270° to 450° C. (calculated at 1 atm.), preferably about 290° to 420° C., more preferably about 300° to 400° C., can be used. If the distillation boiling temperature of the lubricating base oil component is below about 270° C., the viscosity is so low that it reduces the flash point and results in an increase of evaporation loss during operating the engine. In contrast, when it exceeds about 450° C., even though the component has a high aromaticity, it is not effective in preventing the cleaning apparatus from clogging. The highly aromatic light lubricating base oil is required to have an fa of at least 0.22, preferably 0.28 or higher, more preferably 0.35 or higher. In other words, those materials having an fa of at least 0.1, preferably at least 0.2, higher than that of the mineral oil can be used as the highly aromatic light lubricating base oil. It is possible to decrease the mixing ratio of the highly aromatic light lubricating base oil to the mineral oil as the fa value becomes high. However, even when the fa value is about 0.22 to 0.35, it may be preferable that the mixing ratio is about 20 vol % or higher. In this case, the upper limit of the mixing ratio is preferably about 40 vol % because the mixing of a large quantity of the highly aromatic light lubricating base oil likely results in a reduction of the viscosity. Therefore, it is preferred to choose materials having an fa of 0.35 or higher, a dynamic viscosity at 100° C. of 3 to 8 cSt and a boiling point of about 300° to 400° C. (calculated at 1 atm.) as the highly aromatic light lubricating base oil.

Since the lubricating oil of this invention is mainly used for large bore diesel engines, the dynamic viscosity of the resulting lubricating oil be set up at 4 to 18 cSt, preferably 7 to 18 cSt, at 100° C.

Simply stated, the highly aromatic light base oil as mixed with lubricating mineral base oils according to the present invention makes up the low-boiling fraction (front end fraction) of the mixture. When the resulting lubricating oil is distilled, this light base oil can be distilled out at temperatures lower than the point for 30–40 vol % distillation, more specifically, at temperatures not higher than about 450° C. at 1 atm.

The front end fraction of the lubricating oil according to the present invention is principally made of the higher aromatic hydrocarbon whereas the middle or back end fraction is made of an ordinary mineral oil having lower aromaticity. Ordinary mineral oils are separated by vacuum distillation according to their viscosities, but because of incomplete separation, fractions of medium viscosity unavoidably contain some lighter portions. Therefore, even the light, aromatic base oil that is withdrawn as the front end of distillation of a mixed base crude oil contains some mineral oil components in the same range of boiling points, and such mineral oil components are not excluded from the definition of the "highly aromatic light base oil" as used in the present invention.

Two examples of the base oil composition of the lubricating oil according to the present invention are shown in FIGS. 1 (A) and (B). The oil (A) consists of a light, aromatic base oil (hereunder abbreviated to L-AO oil), a medium mineral base oil (M-MO oil), a heavy mineral base oil (H-MO oil) and a superheavy bright stock mineral base oil (BS-MO oil). The oil (B) consists of two types of L-AO oil, M-MO oil and BS-MO oil.

FIGS. 1 (C) and (D) show the base oil composition of two conventional lubricating oils composed of only mineral base oils. The oil (C) consists of M-MO, H-MO and BS-MO oils, and oil (D) which is undesirable consists of M-MO, H-MO and H-AO oils. In FIG. 1, the horizontal axis indicates the distillation temperature and the vertical axis represents the percent fraction of distillation.

Illustrative highly aromatic light lubricating base oils that can be used in the present invention are alkylbenzenes, alkylnaphthalenes and alkylbiphenyls. These base oils may be used either alone or in combination. The chain length and the number of alkyl groups in these base oils are properly determined in consideration of the possible effect on the viscosity of the final lubricating oil.

Suitable alkylbenzenes are bottoms that are obtained as by-products from the manufacture of soft type or hard type synthetic detergents, namely, those alkylbenzene mixtures which have at side chains mono-, di- or trialkyls having a total of about 9 to 20 carbon atoms and the viscosity of which is in the range of from about 3 to 10 cSt (100° C.). Suitable alkylnaphthalenes and alkylbiphenyls are commercially available as heat transfer medium oils or insulating oils (class 2 and class 4 under JIS C 2320), and heavier oils having boiling points not higher than about 450° C. may also be used. For the purpose of the present invention, alkylnaphthalenes and alkylbiphenyls are specially preferred. Very advantageous alkylnaphthalenes include diisopropylnaphthalene, triisopropylnaphthalene, tetraisopropylnaphthalene, diisobutylnaphthalene and triisobutylnaphthalene. Preferred alkylbiphenyls (also known as alkyldiphenyls) are di-, tri- or tetraalkylbiphenyls having isopropyl or isobutyl groups.

The aromaticity (fa), viscosities and distillation temperature ranges of three illustrative highly aromatic light base oils acdording to the present invention are listed in Table 1.

TABLE 1

| Base Oil | fa | Viscosity (cSt at 100° C.) | Distillation Temperature Calculated at 1 Atm. (°C.) |
|---|---|---|---|
| Alkylbenzene (by-product from the manufacture of hard type alkylbenzenes) | 0.28 | 4.24 | 330–380 |
| Alkylnaphthalene (mainly consisting of triisopropylnaphthalene) | 0.44 | 3.22 | 320–330 |
| Alkylbiphenyl (mainly consisting of a mixture of mono-, di- and triisopropyl-biphenyls) | 0.59 | 4.28 | 290–340 |

N.B.: The parameter fa was determined by $^{13}$C-NMR (non-nuclear overhauser enhancement type).

The highly aromatic light lubricating base oil is mixed with the mineral oil in a proportion of about 5 to 40 vol %. But this proportion may be chosen depending upon the fa value. For example, in case of the alkylbenzenes, they are suitably mixed with the mineral base oil in a proportion of about 15 vol % or higher, preferably about 20 vol % or higher, with the upper limit being about 40 vol % from the viewpoints of controlling the viscosity and economy. In contrast, in case of the alkylnaphthalenes and alkylbiphenyls, they are suitably mixed with the mineral base oil in a proportion of about 5 vol % or higher, preferably about 8 vol % or higher, more preferably about 10 vol % or higher.

As already mentioned, vacuum distillation residue (straight asphalt) may be dewaxed with propane or the like, and extracted with a solvent such as furfural, and the resulting extract is purified by hydrodesulfurization or dewaxing. The purified product is bright stock extract oil and this is also a highly aromatic base oil (fa=ca. 0.25). However, this oil is heavy and is not suitable for use in the present invention. If the bright stock extract oil is mixed with lubricating mineral base oils, a substantial amount of sludge forms and the chance of engine wear will increase. Light mineral base oils such as 100 neutral oil are also not suitable for use in the present invention because they have low aromaticity (fa=ca. 0.12) and cannot be mixed with lubricating mineral base oils in a large amount without accelerating the wear of an engine.

As will be apparent from the foregoing paragraph, it is essential for the purpose of the present invention that a light and highly aromatic base oil be mixed with medium or heavy lubricating mineral base oils. The lubricating mineral base oils that are mixed with the light and highly aromatic base oil are medium to heavy refined mineral oils and bright stock oils known as base oils for diesel engine oils. One or more of these base oils are selected depending upon the desired viscosity. They are produced by the following process: (1) a paraffin-base, naphthene-base or mixedbase crude oil is subjected to atmospheric distillation, and the residue is further subjected to distillation, this time in vacuum, and the resulting distillate is separated into light, medium and heavy fractions according to their viscosities within each distillation temperature range; (2) the residue from the vacuum distillation (straight asphalt) is dewaxed with a light hydrocarbon and extracted with a solvent such as furfural to give a raffinate, and the extract is refined by hydrogen treatment or dewaxing.

The light, medium and heavy mineral base oils prepared by the above process are conventionally referred to as neutral oils, and their aromaticity (fa), viscosities and distillation temperature ranges are listed in Table 2. In this table, the respective neutral oils are identified by L-MO, M-MO and H-MO, wherein L: light, M: medium, H: heavy, MO: mineral oil. Table 2 also lists the same parameters for the 150 bright stock oil, which is identified by BS-MO.

TABLE 2

| Mineral Oil Base | fa | Viscosity (cSt at 100° C.) | Distillation Temperature Calculated at 1 Atm. (°C. atm.) 10% | 50% | 90% |
|---|---|---|---|---|---|
| L-MO | 0.12 | 2.5 | 280 | 320 | 400 |
| M-MO | 0.12 | 5.2 | 370 | 430 | 490 |
| H-MO | 0.12 | 11.0 | 450 | 500 | 570 |
| BS-MO | 0.10 | 33.2 | >490 | | |

The L-MO should not be used in the present invention because of promotion of sludge formation and wear. And M-MO, H-MO and BS-MO can be used as mineral base oils to be mixed with the light, highly aromatic base oil (L-AO) according to the present invention. Generally, H-MO and/or BS-MO are suitable for the present invention in view of the viscosity. But M-MO can be used to control the viscosity of this diesel engine lubricating oil.

The lubricating oil of the present invention uses as its base oil the mixture of these lubricating mineral base oils with the light and highly aromatic base oil. The proportion of the highly aromatic base oil is at least 5 vol % of the mixture. It is particularly preferred to use said highly aromatic base oil in an amount of at least 10 vol % of the mixture. However, the viscosity of the mixed base oil is reduced as the content of the highly aromatic base oil is increased. Therefore, to obtain a lubricating oil having the desired viscosity, the preferred upper limit of the highly aromatic base oil is 40 vol % of the mixture.

Table 3 lists the proportions of the base oils for preparing lubricating oils according to the present invention, the aromaticity (fa) and viscosities for the respective proportions, as well as the fractions drawn off by distillation in the temperature range of 270° to 450° C. and the aromaticity for the respective fractions.

TABLE 3

| Base Oils | Proportions (vol %) No. 1 | No. 2 | No. 3 | No. 4 | No. 5 | No. 6 | No. 7 | No. 8 |
|---|---|---|---|---|---|---|---|---|
| Mineral Base Oils | | | | | | | | |
| BS-MO | 20 | | 25 | | 20 | 50 | 40 | 40 |
| H-MO | 60 | 50 | 25 | 50 | 50 | 20 | 20 | 30 |
| M-MO | 10 | | | | 10 | | | |
| Highly Aromatic Base Oils | | | | | | | | |
| Alkylbenzene | | | | 50 | | 30 | 20 | |
| Alkylnaphthalene | 10 | | 50 | | 10 | | 20 | |
| Alkylbiphenyl | | 50 | | | 10 | | | 30 |
| Viscosity (cSt at 100° C.) | 9.97 | 6.40 | 5.50 | 6.40 | 7.50 | 12.4 | 8.53 | 11.39 |
| fa | 0.15 | 0.38 | 0.28 | 0.20 | 0.20 | 0.16 | 0.21 | 0.25 |
| Distillate at 270–450° C. (vol %)* | 25 | 53 | 52 | 48 | 37 | 31 | 41 | 32 |
| Distillate's fa* | 0.24 | 0.59 | 0.44 | 0.28 | 0.55 | 0.28 | 0.39 | 0.57 |

*The figures for the "distillate at 270–450° C." indicate the proportions of the front ends of the respective lubricating oil samples that were drawn off by distillation in the temperature range of 270 to 450° C. The figures for "distillate's fa" represent the fa values of the resulting distillates. Fractions with higher aromaticity represent lubricating oils contained in the front ends, most of which had fa values of at least 0.20 and their primary component was a highly aromatic base oil.

Namely, of the lubricating oils of the present invention, the fractions having a boiling point of 270° to 450° C. calculated at 1 atm. (i.e., primary component) have an fa of at least 0.20. In this connection, the presence of such primary component will especially exhibit an effect for markedly reducing the wear of engine and the clogging of a filter for the lubricating oil as compared with the conventional lubricating oils consisting of a mineral oil only, when heavy fuels having a high C:H ratio, a high residual carbon content and a high asphaltene content.

Therefore, the diesel engine lubricated with the product of the present invention can be operated satisfactorily with coal tar, tar as a by-product of naphtha cracking, heavy oils (e.g., visbreaker bottoms) produced by thermally cracking petroleum residues from atmospheric or vacuum distillation, coker bottoms, heavy oils resulting from coal liquefaction, and mixtures thereof. These fuels can also be used as mixtures with conventional bunker fuel oil. Particularly, the lubricating oil of the present invention is preferred for use to medium speed trunk piston type diesel engine in which lubrication of cylinder-piston and also bearing parts of crankcase is done by the same lubricating oil.

The properties of coal tar, residual type fuel oil C and visbreaker bottoms oil are shown in Table 4 as compared with distillate type fuel oil A.

TABLE 4

| | Properties of Heavy Fuels: Coal Tar | Residual Type* Fuel Oil C (1) | Residual Type* Fuel Oil C (2) | Visbreaker** Bottoms Oil (1) | Visbreaker** Bottoms Oil (2) | Distillate Type Fuel Oil A |
|---|---|---|---|---|---|---|
| Specific Gravity (15/4) | 1.178 | 0.954 | 0.964 | 0.989 | 1.007 | 0.850 |
| Sulfur (wt %) | 0.35 | 2.5 | 3.5 | 3.6 | 3.2 | 1.2 |
| Viscosity (cSt) | | | | | | |
| at 50° C. | 113 | 176 | 138 | 471 | 735 | 2.4 |
| at 98.9° C. | 15 | 23 | 19 | 39 | 49 | |
| Residual Carbon Content (wt %) | 25.0 | 11.1 | 10.6 | 19.0 | 19.3 | 0.1 ↓ |
| Asphaltene (wt %) | 31.2 | 4.3 | 7.3 | 9.9 | 8.4 | 0.1 ↓ |
| n-$C_7$ | >50 | 7.4 | 5.9 | 18.2 | 15.5 | ≈0 |

TABLE 4-continued

| | Properties of Heavy Fuels: Coal Tar | Residual Type* Fuel Oil C (1) | Residual Type* Fuel Oil C (2) | Visbreaker** Bottoms Oil (1) | Visbreaker** Bottoms Oil (2) | Distillate Type Fuel Oil A |
|---|---|---|---|---|---|---|
| insolubles (wt %) | | | | | | |
| C (wt %) | 91.3 | 84.9 | 85.0 | 83.5 | 85.6 | 86.3 |
| H (wt %) | 5.2 | 11.4 | 11.0 | 10.5 | 10.2 | 13.4 |
| C:H (by wt.) | 17.6 | 7.4 | 7.7 | 8.0 | 8.4 | 6.4 |

*Residual type fuel oil C was a mixture of hydrodesulfurized residues from atmospheric distillation and the residue obtained by subjecting the atmospheric distillate to vacuum distillation.

**The visbreaker bottoms were produced by first thermally cracking heavy petroleum oil with a visbreaker and then distilling the cracked product.

Compared with ordinary distillate type fuel oil A, the coal tar, residual type fuel oil C and visbreaker bottoms oil have very high C:H ratios, residual carbon content (as measured by the Conradson's carbon test), asphaltene content, and heptane insolubles. Presumably, the soot and senosphere carbon produced by mist combustion in a diesel engine, as well as the sludge precursor formed by thermal decomposition and polymerization due to incomplete combustion, may enter the lubricating oil through the clearance between piston and cylinder or they may collect on a piston ring. This will accelerate the wear of the engine. Furthermore, these heavy fuels do not form a stable mixture with most of the lubricating mineral base oils; if they are blended with a lubricating oil, their particles agglomerate to form larger insoluble grains. These grains accelerate the engine wear and clog the filter as well as the lubricant purifier. This problem cannot be solved by using conventional mineral oil based diesel engine oils, but can be satisfactorily dissolved by a diesel engine oil using the base oil formulation according to the present invention.

According to the present invention, the mixture of lubricating mineral base oils and the highly aromatic light base oil may contain known additives for diesel engine oils, such as detergents, dispersants (e.g., calcium sulfonate, calcium phenate, and magnesium sulfonate, as well as overbased metallic detergents containing more than a stoichiometric amount of a basic alkaline earth metal in addition to the above mentioned salts), antioxidants (e.g., zinc dialkyldithiophosphates or hindered phenol), corrosion inhibitors, emulsion breakers, antiwear agents and defoaming agents. As a further advantage of the diesel engine oil of the present invention, these additives can be dissolved more easily than in conventional lubricating oils.

The advantages of the present invention will become apparent by reading the following examples which are given here for illustrative purposes only and are by no means intended to limit the scope of the invention.

EXAMPLE 1

The following three base oils were mixed:

| The following three base oils were mixed: | |
|---|---|
| Base Oil | Amount (vol %) |
| Dewaxed 150 bright stock oil (BS-MO) | 50 |
| Dewaxed 500 neutral oil (H-MO) | 20 |
| Hard type alkylbenzene (fa: 0.28) (Pansolve H by Mitsubishi Petrochemical Co., Ltd.) | 30 |

The mixed base oils were further blended with the following additives to prepare a lubricating oil sample.

| Additives | Amount (wt %) |
|---|---|
| Overbased type calcium phenate (base number = 250 mg KOH/g) | 10 |
| Neutral type calcium sulfonate | 1.5 |
| Zn dialkyldithiophosphate | 1.5 |
| Antioxidant of hindered phenol type | trace |
| Defoaming agent | trace |

Two comparative samples were also prepared.

COMPARATIVE EXAMPLE 1

The following base oils were mixed:

| The following base oils were mixed: | |
|---|---|
| Base Oil | Amount (vol %) |
| Dewaxed 150 bright stock oil (BS-MO) | 23 |
| Dewaxed 500 neutral oil (H-MO) | 77 |

The mixed base oils were further blended with the same additives as used in Example 1.

COMPARATIVE EXAMPLE 2

Dewaxed 500 neutral oil (H-MO) was mixed with 4.0 wt % of a superbasic calcium sulfonate.

The three lubricating samples were checked for their performance in a diesel engine by the following test method.

METHOD

Each sample was used as a system oil in a large single-cylinder trunk piston type diesel engine 42X of Mitsui Engineering & Shipbuilding Co., Ltd. The engine had a cylinder diameter of 420 mm, a piston stroke of 450 mm and an output power of 735 H.P. The engine was run fur 10 to 30 hours with a coal tar having the following properties.

Viscosity: 458 cSt at 37.8° C., 15 cSt at 98.9° C.

Residual carbon (as measured by the Conradson's carbon residue test): 25.0 wt %

Asphaltene: 31.2 wt %

C:H (by wt.): 17.6

C:H (atomic ratio): 1.463

After running the engine for the specified period, it was inspected for the wear of piston rings, piston fouling, the amount of sludge in the system oil, and the clogging of the lubricant purifier filter (as indicated by the number of back washes necessary to clean the filter). The results are shown in Table 5 which also lists the properties of the respective lubricating oil samples.

TABLE 5

| | Engine Test Results | | |
|---|---|---|---|
| | Example 1 | Comparative Example 1 | Comparative Example 2 |
| Lubricating Oil | | | |
| Specific Gravity | 0.9041 | 0.8986 | 0.8931 |
| Viscosity (cSt) | 182.3 (37.8° C.) 15.0 (98.9° C.) | 162.3 (37.8° C.) 14.9 (98.9° C.) | 99.3 (37.8° C.) 10.6 (98.9° C.) |
| Piston Ring Wear (mm/1,000 hr) | | | |
| 1st Ring | 1.48 | 2.59 | 10.4 |
| 2nd Ring | 0.26 | 1.05 | 9.0 |
| 3rd Ring | 0.12 | 1.10 | 10.0 |
| 4th Ring | 0.05 | 0.83 | 9.9 |
| 5th Ring | 0.09 | 1.16 | 11.9 |
| (average wear) | (0.40) | (1.35) | (10.2) |
| Piston Fouling (detergency) | Good | Good | Poor |
| Sludge in Lubricant (kg) | 0.43 | 1.8 | 4.4 |
| No. of Back Washes Necessary to Make the Filter Clean | 0 | 8 | More than 30 |

As is clear from Table 5, when the lubricating oil of Example 1 containing an alkylbenzene which was a highly aromatic light base oil was used as a system oil, less wear occurred in the piston rings, less sludge formed, and no filter clogging took place. However, when the lubricating oil samples of Comparative Examples 1 and 2 were used, increased wear and sludge formation occurred together with the filter clogging.

EXAMPLE 2 AND COMPARATIVE EXAMPLE 3

All or part of the base oils shown in Table 6 were blended as indicated in Tables 7 and 8 to prepare lubricating oil samples A to L. They were used in diesel engines that were run with coal tar, visbreaker bottoms, residual type fuel oil C, and the mixture of visbreaker bottoms and distillate type fuel oil A (for the properties of each fuel, see Table 4 above).

TABLE 6

| Base Oil | Nature | Aromaticity (fa) | Viscosity (cSt @100° C.) | Abbr. |
|---|---|---|---|---|
| Mineral Base Oils | | | | |
| Bright Stock Oil 150 | Heavy | Low (0.10) | 33.2 | BS-MO |
| Neutral Oil 500 | Heavy | Low (0.12) | 11.0 | H-MO |
| Neutral Oil 150 | Medium | Low (0.12) | 5.2 | M-MO |
| Synthetic, Highly Aromatic Light Base Oils | | | | |
| Alkylbenzene | Light | High (0.28) | 4.2 | ABZ-AO |
| Alkyl- | Light | High (0.44) | 3.2 | ANP-AO |

TABLE 6-continued

| Base Oil | Nature | Aromaticity (fa) | Viscosity (cSt @100° C.) | Abbr. |
|---|---|---|---|---|
| naphthalene | | | | |
| Alkyl-biphenyl | Light | High (0.59) | 4.3 | ABP-AO |
| Others | | | | |
| Neutral Oil 100 | Heavy | Low (0.12) | 2.5 | L-MO |
| Bright Stock Extract | Heavy | High (0.25) | 32.9 | BS-EX |
| Alkyl-biphenyl Bottoms | Heavy | High (0.39) | 11.6 | ABB-AO |

TABLE 7

Lubricating Oil Samples of Example 2 (vol %)

| Base Oil | Sample A | B | C | D | E | F | G |
|---|---|---|---|---|---|---|---|
| BS-MO | | | 25 | 20 | 40 | 40 | 15 |
| H-MO | 50 | 50 | 25 | 50 | 20 | 30 | 80 |
| M-MO | | | | 10 | | | |
| ABZ-AO | | | | | 20 | | |
| ANP-AO | 50 | | 50 | 10 | 20 | | 5 |
| ABP-AO | | 50 | | 10 | | 30 | |
| Viscosity (cSt at 100° C.) | 4.61 | 6.40 | 5.50 | 7.50 | 8.53 | 11.39 | 11.40 |

TABLE 8

Lubricating Oil Samples of Comparative Example 3 (vol %)

| Base Oil | Sample H | I | J | K | L |
|---|---|---|---|---|---|
| BS-MO | 25 | | | | 25 |
| H-MO | 25 | 50 | 50 | 100 | 75 |
| L-MO | 50 | | | | |
| ABB-AO | | 50 | | | |
| BS-EX | | | 50 | | |
| Viscosity (cSt at 100° C.) | 5.39 | 11.01 | 17.65 | 11.0 | 13.8 |

Figure 2:
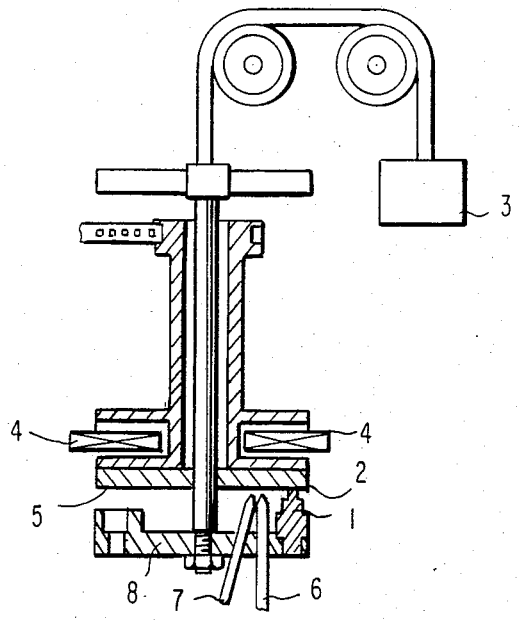
FIG. 2 is a diagram of the apparatus used to test the wear resistance of a lubricated diesel engine.

Each of the lubricating oil samples was used in a wear test with a pin-on-disk wear tester of the design illustrated in FIG. 2. The test device comprised a pin (test piece) 1 made of the same material as the piston ring of a diesel engine and a rotary disk 2 made of the same material as the cylinder liner of marine diesel engine. The pin was fixed by a holder 8 and kept in contact with the rotary disk that was driven at constant speed by an external motor. The pin was pulled upward by a weight 3 and pressed against the disk in a vertical direction. The disk was heated by a heating coil 4 and its surface temperature was measured with a thermocouple 5. Metered amounts of the lubricating oil and fuel were directed onto the disk separately (the lubricant through a nozzle 6 and the fuel through another nozzle 7), and the two intermingled with each other on the surface of the disk.

Operating Conditions

Disk Temperature: 200° C.
Disk Rotational Speed: 500 rpm
Load at Pin Contact Area: 640 kgf/cm$^2$
Lubricant Feed Rate: 0.25 ml/min
Fuel Feed Rate: 0.025 ml/min
Frictional Distance: 1,080 m

TABLE 9

| Sample | Fuel Type and Amount of Wear (μm/hr)* Coal Tar | Visbreaker Bottoms | Residual Type Fuel Oil C | Visbreaker Bottoms + Residual Type Fuel Oil C (1:1) |
|---|---|---|---|---|
| Example 2 | | | | |
| A | 44 | 49 | 19 | 34 |
| B | 24 | | | |
| C | 44 | | 17 | |
| D | 24 | 21 | 17 | 22 |
| E | 70 | 34 | 24 | 24 |
| F | 39 | 32 | 24 | 27 |
| G | 47 | | | |
| Comparative Example 3 | | | | |
| H | 216 | | | |
| I | 343 | | | |
| J | 330 | | | |
| K | 118 | 50 | 41 | 69 |
| L | 95 | 38 | 30 | 48 |

*The wear of the pin was indicated by the reduction in length.

As Table 9 clearly shows, samples A to G each containing highly aromatic light base oils exhibited a marked reduction in wear in the presence of coal tar fuel as compared with samples H, K and L (mineral oil based) or samples I and J (containing aromatic but heavy base oils). Samples A to G were also effective in the presence of visbreaker bottoms and residual type fuel oil C used individually, and when the two fuels were combined, the effectiveness of these samples was almost the same as in the presence of coal tar. The same experiment was conducted in the presence of distillate type fuel oil A whose properties were also listed in Table 4. The wear reducing performance of samples A to G was substantially the same as that of comparative samples H to L. It is therefore concluded that the diesel engine oil according to the present invention will exhibit a marked wear reducing effect when it is used in a diesel engine designed to run with a less compatible fuel such as a heavy fuel having high C:H ratio and high residual carbon and asphaltene contents, or a mixture of petroleum and coal base fuels, or a mixture of a thermally cracked heavy oil and a straight run heavy oil. As a further advantage, the lubricating oil of the present invention is not likely to clog the filter or other devices on the lubricant purifying line.

While the invention has been described in detail and with reference to specific embodiments thereof, it will be apparent to one skilled in the art that various changes and modifications can be made therein without departing from the spirit and scope thereof.

What is claimed is:

1. A lubricating oil for a trunk piston type diesel engine which reduces the wear of a piston ring of the engine and the clogging of a filter of lubricant purifier comprising a mixture of (A) a lubricating mineral base oil and (B) a highly aromatic light lubricating base oil, wherein said highly aromatic light lubricating base oil (B) has an aromaticity fa≧0.22 wherein fa is an aromatic hydrocarbon distribution parameter, has a boiling point of about 270° to 450° C. as calculated at 1 atm., is at least one selected from the group consisting of alkylbenzenes, alkylnaphthalenes and alkylbiphenyls, and is present in said lubricating oil in an amount in the range of about 5 to 40 vol %, and said lubricating oil has a dynamic viscosity of 7 to 18 cSt at 100° C.

2. A lubricating oil as claimed in claim 1, wherein said highly aromatic light lubricating base oil (B) is present in said lubricating oil in an amount in the range of about 8 to 40 vol %.

3. A lubricating oil as claimed in claim 1, wherein the aromaticity fa of said highly aromatic light lubricating base oil (B) is 0.28 or higher.

4. A lubricating oil as claimed in claim 1, wherein the aromaticity fa of said highly aromatic light lubricating base oil (B) is 0.35 or higher.

5. A lubricating oil as claimed in claim 1, wherein said highly aromatic light lubricating base oil (B) has an aromaticity fa of 0.35 or higher and a boiling point of about 300° to 400° C. as calculated at 1 atm.

6. A lubricating oil as claimed in claim 1, wherein said highly aromatic light lubricating base oil (B) is selected from the group consisting of alkylbenzene mixtures having as their side chains mono-, di or trialkyls having a total of 9 to 20 carbon atoms and a viscosity in the range of from about 3 to 10 cSt at 100° C.

7. A lubricating oil as claimed in claim 1, wherein the side chains of the alkylnaphthalenes are an isopropyl group and/or an isobutyl group, and the number thereof is 2 to 4.

8. A lubricating oil as claimed in claim 1, wherein the side chains of the alkylbiphenyls are an isopropyl group or an isobutyl group, and the number thereof is 2 to 4.

9. A lubricating oil as claimed in claim 1, wherein said lubricating mineral base oil (A) is obtained from paraffinic or mixed base oils.

10. A lubricating oil as claimed in claim 1, wherein said lubricating mineral base oil (A) is composed of a hydrocarbon having an aromaticity fa of about 0.10 to 0.13 and a boiling point of about 450° C. or higher as calculated at 1 atm.

11. A lubricating oil as claimed in claim 1, used wherein the engine uses a heavy liquid fuel having a high asphaltene content.

12. A lubricating method for a trunk piston type diesel engine which reduces the wear of a piston ring of the engine and the clogging of a filter of lubricant purifier comprising using a lubricating oil comprising a mixture of (A) a lubricating mineral base oil and (B) a highly aromatic light lubricating base oil, wherein said highly aromatic light lubricating base oil (B) has an aromaticity fa$\geqq$0.22 wherein fa is an aromatic hydrocarbon distribution parameter, has a boiling point of about 270° to 450° C. as calculated at 1 atm., is at least one selected from the group consisting of alkylbenzenes, alkylnaphthalenes and alkylbiphenyls, and is present in said lubricating oil in an amount in the range of about 5 to 40 vol %, and said lubricating oil has a dynamic viscosity of 7 to 18 cSt at 100° C.

13. A lubricating method as claimed in claim 12, wherein said highly aromatic light lubricating base oil (B) is present in said lubricating oil in an amount in the range of about 8 to 40 vol %.

14. A lubricating method as claimed in claim 12, wherein the aromaticity fa of said highly aromatic light lubricating base oil (B) is 0.28 or higher.

15. A lubricating method as claimed in claim 12, wherein the aromaticity fa of said highly aromatic light lubricating base oil (B) is 0.35 or higher.

16. A lubricating method as claimed in claim 12, wherein said highly aromatic light lubricating base oil (B) has an aromaticity fa of 0.35 or higher and a boiling point of about 300° to 400° C. as calculated at 1 atm.

17. A lubricating method as claimed in claim 12, wherein said highly aromatic light lubricating base oil (B) is selected from the group consisting of alkylbenzene mixtures having at their side chains mono-, di or trialkyls having a total of 9 to 20 carbon atoms and a viscosity in the range of from about 3 to 10 cSt at 100° C.

18. A lubricating method as claimed in claim 12, wherein the side chains of the alkylnaphthalenes are an isopropyl group and/or an isobutyl group, and the number thereof is 2 to 4.

19. A lubricating method as claimed in claim 12, wherein the side chains of the alkylbiphenyls are an isoprophyl group or an isobutyl group, and the number thereof is 2 to 4.

20. A lubricating method as claimed in claim 12, wherein said lubricating mineral base oil (A) is obtained from paraffinic or mixed base oils.

21. A lubricating method as claimed in claim 12, wherein said lubricating mineral base oil (A) is composed of a hydrocarbon having an aromaticity fa of about 0.10 to 0.13 and a boiling point of about 450° C. or higher as calculated at 1 atm.

22. A lubricating method as claimed in claim 12, wherein the engine lubricated uses a heavy liquid fuel having a high asphaltene content.

* * * * *